US005597165A

United States Patent [19]

Rundle et al.

[11] Patent Number: 5,597,165

[45] Date of Patent: Jan. 28, 1997

[54] GAME DEVICE FOR A RADIO CONTROLLED VEHICLE

[76] Inventors: Christopher Rundle, 12598 SW. 60th Ct., Miami, Fla. 33156; Michael Borell, 7787 SW. 86th St., Apt. 310, Miami, Fla. 33143

[21] Appl. No.: 588,070

[22] Filed: Jan. 17, 1996

[51] Int. Cl.[6] ..... A63F 7/26

[52] U.S. Cl. ..... 273/442; 273/108.56; 273/129.5; 446/456

[58] Field of Search ..... 273/442, 85 F, 273/129 S, 108.22, 108.56; 446/456

[56] References Cited

U.S. PATENT DOCUMENTS

| | | | |
|---|---|---|---|
| 3,030,133 | 4/1962 | Brandell | 273/129 S X |
| 3,338,576 | 8/1967 | Andriulis | 273/108.56 |
| 4,346,893 | 8/1982 | Landsinger et al. | 273/108.56 |
| 4,591,158 | 5/1986 | Samson et al. | 446/456 X |
| 5,295,890 | 3/1994 | Myers | 446/456 |

FOREIGN PATENT DOCUMENTS

| | | | |
|---|---|---|---|
| 847284 | 6/1939 | France | 273/85 F |
| 2521441 | 8/1983 | France | 273/85 F |
| 2668380 | 4/1992 | France | 273/85 F |
| 655677 | 2/1938 | Germany | 273/85 F |
| 716733 | 1/1942 | Germany | 273/85 F |
| 1453964 | 1/1969 | Germany | 273/85 F |
| 2049094 | 5/1971 | Germany | 273/85 F |
| 3803839 | 8/1989 | Germany | 273/129 S |

*Primary Examiner*—Paul E. Shapiro
*Attorney, Agent, or Firm*—McHale & Slavin, P.A.

[57] ABSTRACT

A radio controlled vehicle having a device attached to the front of the vehicle for scooping and retaining a playing ball in a retaining area. The ball is scooped and captured by driving the vehicle towards the ball with sufficient velocity to guide it between channeling rails and through a flexible retaining barrier which prevents further escape of the ball during vehicle maneuvering. The vehicle also includes a ball propelling device which is capable of forcefully dislodging the ball from its retaining area and imparting a velocity to the ball away from the vehicle. This system can be used to play a game whereby the bounds of a playing area and goals are defined, and players maneuver their vehicles within this area. Players capture the free ranging ball, maneuver it towards a goal, aim and shoot the ball in an attempt to score. Errant in-bound shots would then be re-captured, re-maneuvered, and re-shot during the course of play.

18 Claims, 3 Drawing Sheets

GAME DEVICE FOR A RADIO CONTROLLED VEHICLE

FIELD OF THE INVENTION

This invention relates generally to radio controlled vehicles and more particularly to a game device which is mounted to the radio controlled vehicle which includes a ball scoop with a retaining apparatus and a ball propelling device activated by a radio controlled command. This arrangement allows the ball to be maneuvered and shot towards a target and then retrieved via the scoop by driving the vehicle towards the ball.

BACKGROUND OF THE INVENTION

Presently, radio controlled (RC) cars, trucks, and other such vehicles are extremely popular worldwide with enthusiasts ranging from all age groups. As a result, major international competitions exist with professional drivers garnering sponsorships from a large variety of equipment sponsors including such manufacturers as Futaba, Airtronics, Kyosho, Hitech, Traxxas, Yokomo, and Tamiya. A variety of international organizations exist which also organize racing and performance competitions. These organizations include the International Federation of Model Auto Racing (IFMAR), Radio Operated Auto Racing (ROAR), European Federation of Radio Operated Automobiles (EFRA), and the Fourth Association of Model Auto Racing (FAMAR).

Generally, RC vehicles provide a low cost alternative to racing enthusiasts who do not race full sized vehicles due to age, cost or the threat of injury. Thus, the thrills of racing can be experienced without the inherent dangers. Racing typically occurs on tracks ranging from ovals to complex patterns, and from paved to off road conditions. The cars complete a series of laps until a winner is determined from the fastest car and remotely located driver. Today, RC cars of all complexity levels and sizes (e.g. 1/24th through 1/4 scale) are used by adults and children alike for uses far simpler than racing. Today, a magnitude of users can be found who simply enjoy remotely roving their RC cars around a large given area such as a parking lot.

Along these lines, many observers find the constant repetition of racing laps to be uninteresting. Hence, while popular, model racing has limited appeal to the average sports enthusiast who is interested in team oriented sports or in reaching some type of goal that requires strategy. Team sports carry appeal because they pit one team against the other, with each team desiring to score as many points as possible within an allotted time period. A complex strategy of offense and defense evolves for each sport beyond that of racing's speed and driving skills. Consequently, many drivers are also enthusiasts of a wide variety of other sports.

Such team sports include football, soccer, basketball, and hockey. As is well known, soccer is the most popular and widely followed team sport in the world. Hockey (both street and ice) is also very popular worldwide. Reasons for soccer's appeal include its simplicity and overall low cost to play. With any plot of land or vacant lot a soccer game can be organized and played. Also, soccer lends itself to all skill levels because a player need only minimal skills to start.

Given the immense popularity of soccer (and other team sports), and the relatively unrelated popularity of RC cars, a game might exist which would combine the enthusiasm for these endeavors and allow an operator to use an RC car as an actual player. The car should be capable of retrieving and retaining a ball so that the car's roving mobility can be strategically used to move the ball into scoring position. A goal would be provided whereby the car could propel the ball forward upon a given RC command. The game might proceed then—much like soccer—where a series of cars on one team would offensively attack the opponents goal and defensively attempt to prevent scoring upon their own goal.

Thus, what is needed in the art into which this invention applies, is such a device that allows RC vehicles to be manipulated/incorporated into a game type situation such as soccer, wherein the vehicle is capable of scooping a ball with a retaining apparatus and propelling the ball based upon a radio controlled command.

SUMMARY OF THE INVENTION

The instant invention is an attachment to a radio controlled vehicle and consists of a scoop shaped bracket capable of retrieving the circular shaped ball with provisions of maintaining the ball within a holding area until projected by use of a radio controlled release arm capable of projecting the ball outward and away from the holding area. The radio controlled triggering mechanism allows the projecting device to be retracted and reset, allowing the operator to maneuver the radio controlled vehicle into position where it can pick up the ball and repeat the process. It is within the provisions of this invention to allow rotation of the holding area either manually or through radio control operation allowing the projectile to be expelled at various angles and/or inclines.

Accordingly, it is an object of the present invention to provide an apparatus which attaches to an RC car for scooping and retaining a ball, so that the car may be used to strategically maneuver the ball into scoring position.

It is a further object of the present invention to provide a propelling device for shooting the retained ball forwards as a result of an RC command from the user.

It is yet another object of the present invention to make the propelling device spring loaded and self reciprocating so that the ball can be quickly scooped, retained, and fired again as desired.

It is still another object of the present invention to provide operator control of the shooting angle of the ball.

It is yet another object of the present invention to mount the scooping and propelling device on a car having differential, multi-directional steering.

It is a further object of the present invention to include a ball which has been standardized in size and weight, and which contains a portion of loosely flowing material (e.g. liquid or weighted pellets or sand) to prevent the ball from rolling too far away from a player car.

It is still another object of the present invention to provide a robust and sturdy scooping and propelling device for mounting on an equally robust and sturdy vehicle which can withstand the rigors and hard contact associated with game play.

Still another object of the present invention is to provide a method of play associated with the equipped vehicle.

Other objects and advantages of this invention will become apparent from the following description taken in conjunction with the accompanying drawings wherein set forth, by way of illustration and example, are certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a preferred specific embodiment, it will be readily apparent to those skilled in this art that various modifications, rearrangements and substitutions can be made without departing from the spirit of the invention. The scope of the invention is defined by the claims appended hereto.

Figures 1, 1A:
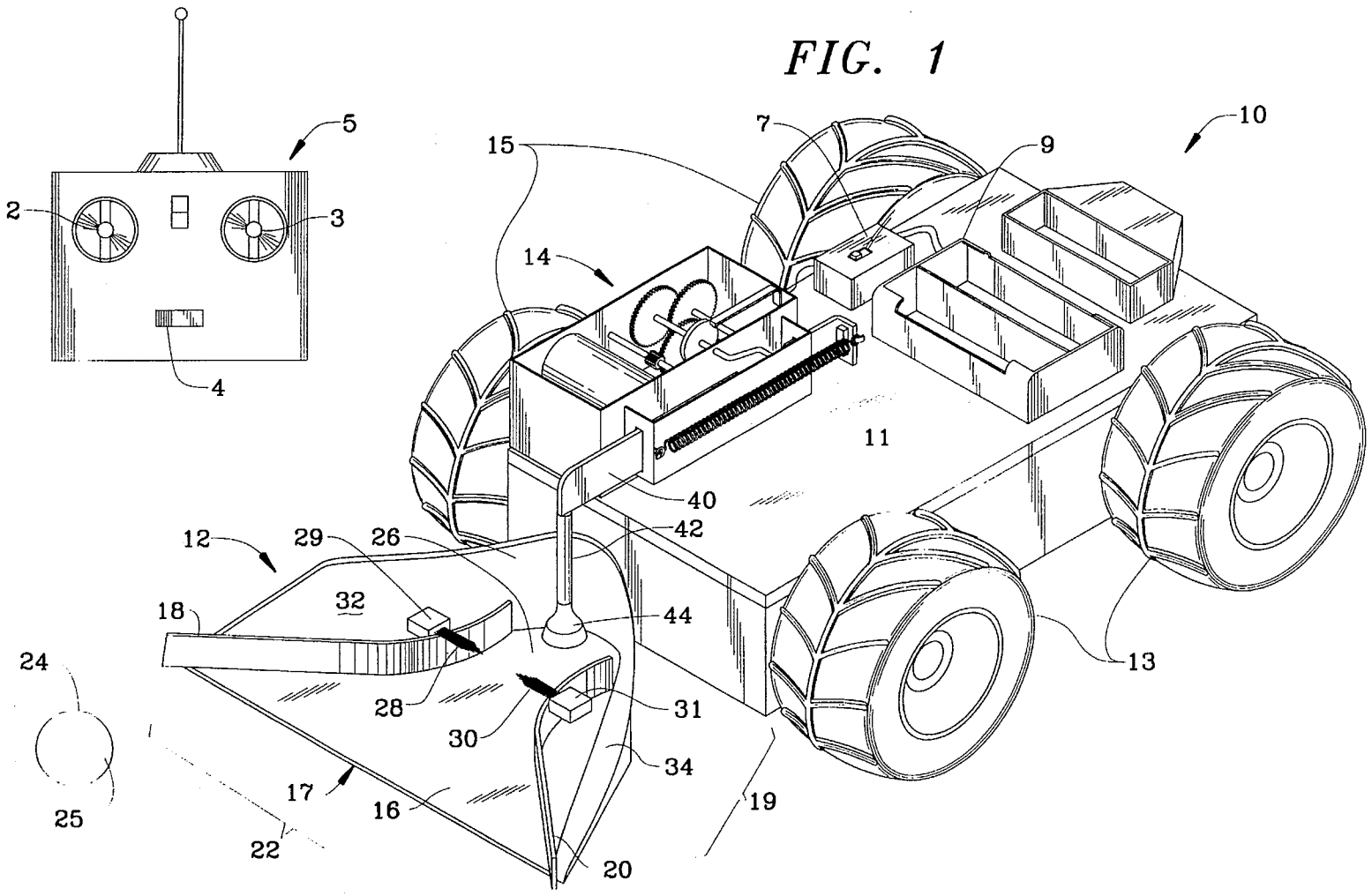
FIG. 1 is a pictorial view of an RC car with the scooping device and ball propelling device attached to the car.
FIG. 1A shows the transmitter control device as used with the vehicle of FIG. 1.

Referring now to FIGS. 1 and 1A, an example RC car 10 is shown with a control transmitter 5, a receiver 7, and a master battery pack 9. The receiver 7 might also include its own battery source. FIG. 1 additionally shows an embodiment of a scooping device 12 and ball propelling device 14 as mounted on the car 10.

The scooping device 12 consists of thin, yet sturdy bottom plate 16 which tapers at its leading edge 17 and is mounted so that it barely clears the ground. This plate is typically made from plastic or aluminum. A pair of guide rails 18 and 20 are attached substantially vertical to the plate 16 so that they angle outward from the front of the scoop 12 and provide a mouth 22 appropriate for receiving and guiding a ball 24.

The rails 18, 20, narrow in width as they proceed towards the trailing edge 19 of the scoop 12 to form a receiving area 26 for the ball 24. To retain the ball 24 from being dislodged from area 26, a pair of brushes 28 and 30 are mounted on mounts 29 and 31 so that they protrude inward over the rails 18, 20 and towards the formed channel. In practice, a ball 24 is retrieved by driving the vehicle 10 towards the ball 24 so that the scope 12 and mouth 22 will encompass and entrap the ball 24. The forward velocity of the vehicle 10 will push the ball 24 up the channel to encounter the brushes 28, 30. The velocity differential of the ball 24 relative to the car 10 will cause the ball to push past the brushes to that it is retained in area 26.

The brushes are flexible enough to allow entry of the ball 24 into retaining area 26 under average (and higher) driving velocities, with an average velocity being approximately one-half of the car's upper velocity limit. Conversely, the brushes are stiff enough so that subsequent movement by the car 10 will not dislodge the ball 24. This occurs because the velocities of the two objects are now relatively equal in that the ball 24 is being carried by the car 10. Hence the force exerted on brushes 28, 30 by any ball movement within area 26 is not enough to overcome the brush stiffness. Alternatively, other flexible materials might be used instead of brushes including plastic tabs, or a spring-loaded gating system. Alternatively still, a remotely controlled gating system might be used to strategically open and close (when commanded) to similarly capture the ball.

Figure 2:
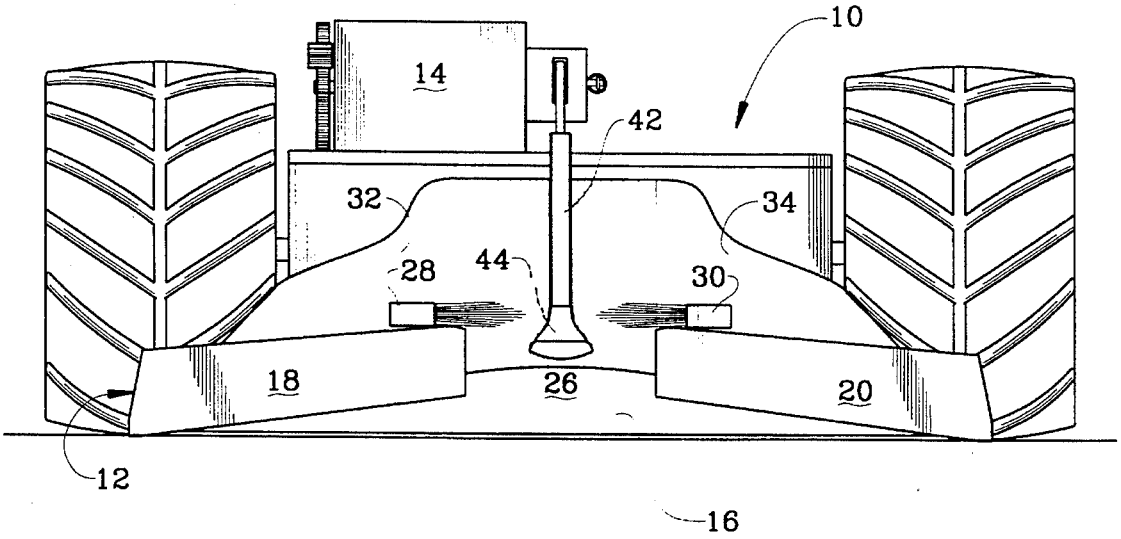
FIG. 2 is a front view of the car showing the scooping device and ball propelling device.
Figure 3:
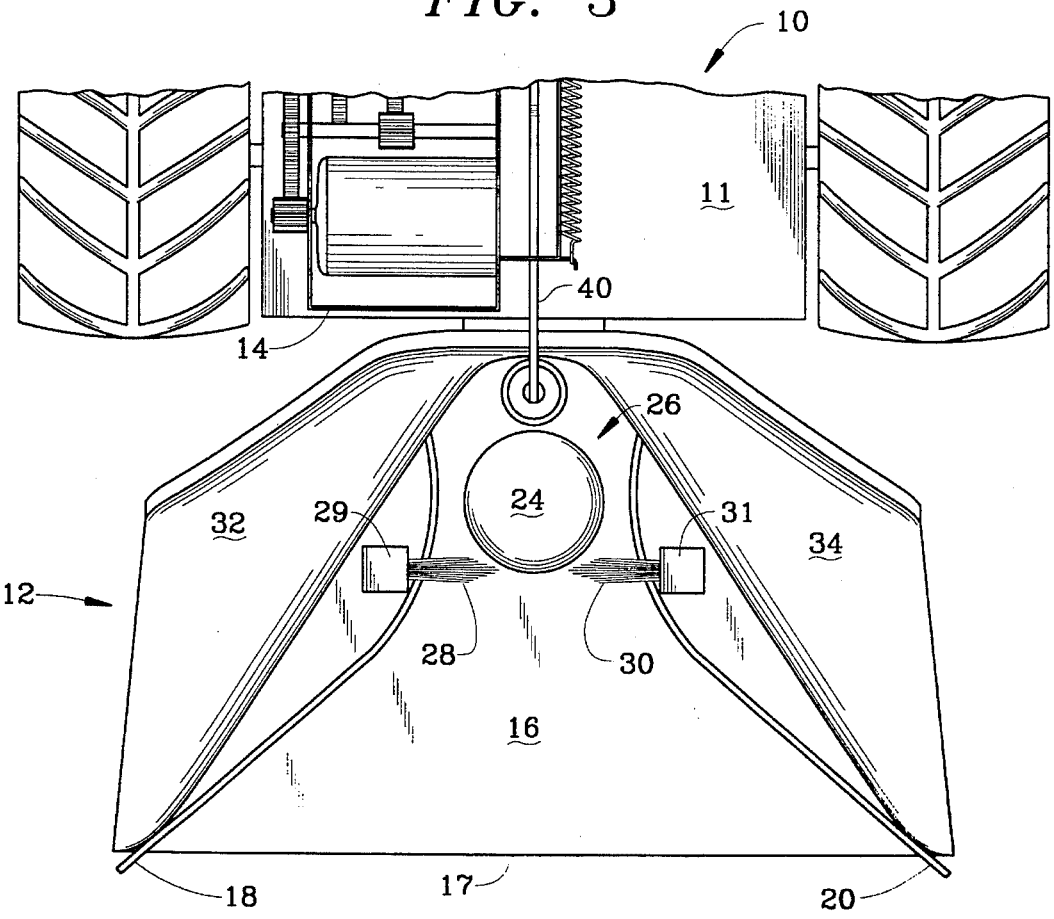
FIG. 3 is a top view of the car showing the scooping device and a portion of the ball propelling device.

Referring now to FIGS. 2 and 3, the scoop 12 is further illustrated to show retention of the ball 24 by the brushes 28, 30. The scoop 12 includes curved, horseshoe-shaped retaining walls 32 and 34 which extend vertically upwards and deflect the ball 24 back into the channel path if the ball happens to bounce up and away from being retained.

Once the ball 24 is scooped and retained, the car 10 can transport and maneuver it past opponent cars or obstacles. The user might either pass the ball towards another teammate's car or shoot the ball directly at the opponent's goal. Accordingly, a ball propelling device 14 is mounted to the frame 11 of the car 10 for quickly pushing the ball 24 from the retaining area 26 and past the brushes 28, 30. Device 14 is activated by a signal from the control transmitter 5 by depressing the "fire" button 4. The signal is received and processed by the receiver 7. Alternatively, this fire control might be located on separate transmitter. While one player could operate both transmitters, separate devices might would allow one co-player to drive the vehicle while the other co-player handled the shooting of the ball.

Figure 4:
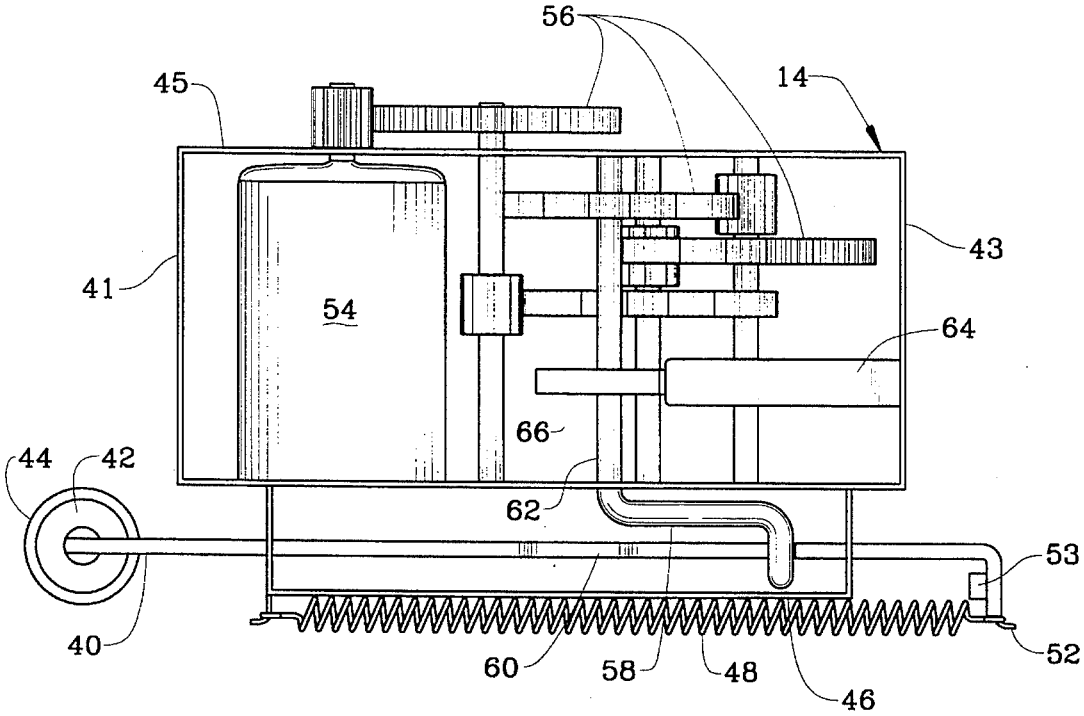
FIG. 4 is a top view of an embodiment of the ball propelling device.
Figure 5:
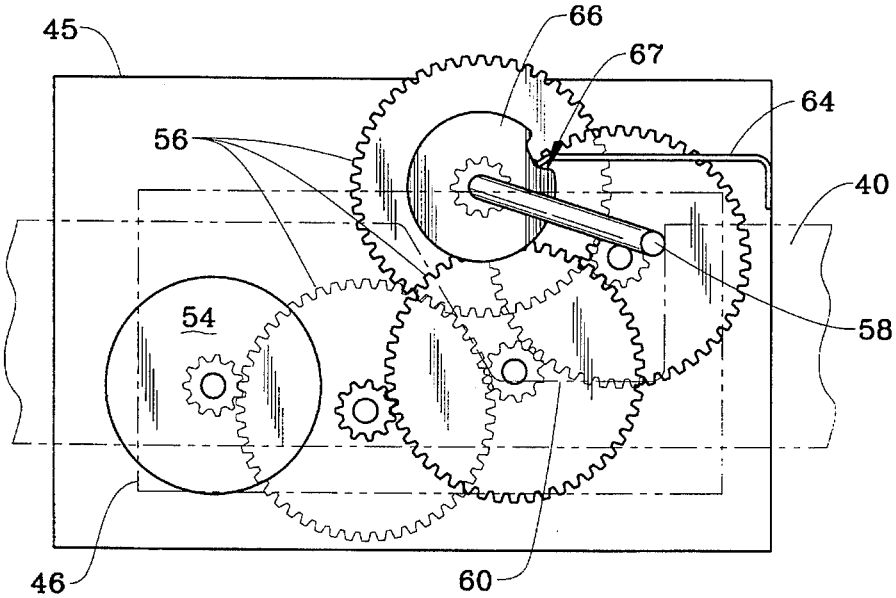
FIG. 5 is a side view of the embodiment of the ball propelling device of FIG. 4.

Referring also to FIGS. 4 and 5, the propelling device 14 in this case includes a front end 41 and back end 43, with a spring loaded slider bar 40 which moves linearly forwards and backwards to bring a rod 42 into fast contact with the ball 24. The rod 42 is positioned to extend over and down towards retaining area 26 so that the rod 42 hangs down behind the retained ball 24. The metal (or plastic) rod might include a rubberized endcap 44, as shown, to minimize wear on the ball 24. The bar 40 is slidably mounted in a bracket 46 with the front end of a spring 48 attached to tab 50 on bracket 46, and the back end of the spring 48 attached to tab 52. As a result, when the spring is in its natural (unstretched) state, then the bar 40 is extended forward. Conversely, when the bar is retracted, the spring is loaded, or stretched.

To retract the bar 40, the present embodiment uses an electric motor 54 as connected to a series of gears 56 for turning a crank 58. The crank 58 projects laterally from the housing 45 of the propelling device 14. The bar 40, in turn, has an angled cutout 60 for receiving the crank 58. The crank axle 62 supports a notched metal disk 66 wherein a flexible electrical contact extends from the housing 45 of device 14 and fits into this notch 67. Upon activation of the motor 54, the crank turns counterclockwise, thus contacting the upwardly sloping edge of notch 60 and pushing the bar 40 further backwards. This action further loads the spring 48 which resists the backward linear motion of the bar 40.

When the crank 58 rotates a sufficient amount, it will then exit the notch 60. The bar 40 will be free to slide and the loaded spring 48 will cause the bar 40 to shoot forward until the bracket 46 encounters the bar's rear stop pad 53. Rod 42 and endcap 44 will then quickly strike the retained ball 24 and cause it to shoot forward, past the brushes 28, 30, and at a swift velocity forward towards its target. With continued rotation of the motor 54 and crank 58, the electrical contact 64 will exit the notch 67 and ride flexed along the outer edge of the disk 66. Upon continuing counterclockwise, the crank 58 will eventually enter and catch the notch 60 again, which moved forward with bar 40. Bar 40 is then pushed back to its original position until notch 67 on disk 66 rotates around to once again encompass the electrical contact 64. The resulting lack of metal upon metal contact between the contact 64 and the disk 66 shuts down the motor 54. Hence, after shooting the ball forward, the striking rod 42 is almost immediately reciprocated to its original position so that the ball 24 might be immediately scooped, retained, and shot again.

The rotary device 14 has certain advantages in that it uses a minimum amount of current to propel the ball forward at a great velocity. This is achieved through the aid of the rotary motor and geared assembly for translating the spring loaded sliding bar. Electrical current drain is an important concern because it affects the overall performance and duration of RC car operation. Other ball propelling devices might also be used, with assemblies utilizing such items as electromagnets, solenoids, servomotors, vacuum pumps, gravity ramps, and the like. Some such devices might reciprocate even faster and be more powerful than the above embodiment. However, the tradeoff might include higher current drains resulting from such alternative setups.

A further feature, not shown in the drawings, includes attaching an additional servomotor, as controlled by a spare transmitter channel, to control the elevation of the scoop 12. Such elevation control could be used to raise, lower or rotate the firing angle of the ball towards its target. Moreover, the height of the plate 16 above the ground could be adjusted to optimize success in scooping the ball under various terrain and surface conditions.

Referring again to FIG. 1, yet another feature of the present embodiment includes differential steering on the RC car 10. In other words, neither the front nor the back wheels pivot left or right to achieve directional steering of the car. Instead, the left wheels 15 and right wheels 13 are independently and proportionally driven forwards and backwards (e.g. like a tank) by movements of the controls gimbals 2 and 3 on transmitter 5. For the present application of attaching a mechanism for scooping and shooting the ball, this type of steering is advantageous in that the vehicle can be quickly rotated in one place without needing to move forwards or backwards. Hence, a user might better aim shots at a target with such a steering system.

Another problem addressed and solved by the present invention is that of excessive ball roll after shots, passes or deflections by the player cars. In this case, the ball 24 is specially constructed of a hard, plastic material and includes a flowable material dispensed in its center up to a partial level such as 25. This flowable material will dampen the rolling ability of the ball. Such materials might include a liquid (e.g. water), or dry particulate materials such as gravel, pellets or sand.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A radio controlled land based vehicle comprising:

a means for entrapping and channeling a ball into a retaining area;

a flexible retaining means allowing retention of said ball in said retaining area;

a ball propelling means for dislodging said ball from said flexible retaining means and imparting a directional velocity to said ball away from said vehicle.

2. A radio controlled land-based vehicle according to claim 1, wherein said means for entrapping is further defined as a flat bottom plate having a front and back end; and vertically extending retaining walls for deflecting said ball into said retaining means.

3. A radio controlled land-based vehicle according to claim 1 wherein said ball retaining means includes a pair of flexible brushes which extend inwardly forming a channeled path.

4. A radio controlled land-based vehicle according to claim 1 wherein said ball retaining means is a flexible structure which forms a channeled path to said retaining area.

5. A radio controlled land-based vehicle according to claim 1 wherein said ball propelling means includes a propelling rod which extends to a rear section of said ball retaining area, said rod being released upon radio command to strike said ball, with said rod being retrieved quickly thereafter to its original striking position.

6. A radio controlled land-based vehicle according to claim 5 wherein said propelling rod is based by a spring.

7. A radio controlled land-based vehicle according to claim 5 wherein said propelling rod is attached to a spring-biased sliding bar, said propelling means including a rotary motor, a gearset attached to a rotary crank, and a rotary cutoff contact switch, said motor driving said rotary crank which rotates to engage, bias, and release said bar, said crank then continuing its revolution to re-engage and retrieve said bar to its original position, said motor stopping when said switch disconnects.

8. A radio controlled land-based vehicle according to claim 5 wherein said propelling rod is attached to a solenoid for causing forward and reverse movement of said propelling rod.

9. A radio controlled land-based vehicle according to claim 5 wherein said propelling rod is attached to an electromagnet causing forward and reverse movement of said propelling rod.

10. A radio controlled land-based vehicle according to claim 5 wherein said propelling rod is attached by a servo causing forward and reverse movement of said propelling rod.

11. A radio controlled land-based vehicle according to claim 5 wherein said propelling rod includes a rubberized endcap for striking said ball.

12. A radio controlled land-based vehicle according to claim 5 wherein said ball includes a flowable weighting means for slowing the rotation of said ball.

13. A radio controlled land-based vehicle according to claim 12 wherein said flowable weighting means is a liquid.

14. A radio controlled land-based vehicle according to claim 12 wherein said flowable weighting means is a dry particulate matter.

15. A radio controlled land-based vehicle according to claim 1 wherein said vehicle includes a left and right set of wheel and said vehicle is driven by differential forward and backward movement of the left and right set of wheels.

16. A radio controlled land-based vehicle according to claim 1 wherein said vehicle includes a transmitter means and a receiver means for controlling said vehicle and said propelling means, said vehicle further including a battery pack for powering movement of said vehicle and said propelling means.

17. A method of using said radio controlled land-based vehicles for playing a game between at least two teams said method including the steps:

defining the boundaries of a playing area;

defining at least one goal on the playing area;

positioning at least one radio control vehicles comprising a means for entrapping and channeling a ball into a retaining area, a flexible retaining means allowing retention of said ball in said retaining area and a ball propelling device for dislodging said ball from said flexible retaining means and imparting a directional velocity to said ball away from said vehicle on said area for each said team;

positioning a ball on said playing area;

maneuvering at least one of the vehicle within said playing area to scoop said ball into said vehicle's retaining area by driving said vehicle towards said ball with sufficient velocity to channel said ball into said flexible retaining means;

maneuvering said vehicle with said ball around opposing vehicles and towards said goal; and aiming said vehicle towards said goal and commanding said ball propelling device to shoot said ball.

18. A radio controlled land-based vehicle comprising:

a front mounted horseshoe-shaped ball retaining means including front and back portions, a bottom plate, vertically extending retaining walls, and a pair of tapered guide rails for entrapping and channeling a ball into a retaining area within said retaining means;

a pair of channeling members mounted opposite to each other to define the front of said retaining area, said channeling members disposed to allow scoopable entry and retention of said ball into said retaining area;

a ball propelling means for dislodging said ball from said retaining area past said retaining means and imparting a directional velocity to said ball away from said vehicle.

* * * * *